US008596494B2

(12) United States Patent
Jones

(10) Patent No.: US 8,596,494 B2
(45) Date of Patent: Dec. 3, 2013

(54) GAS RECOVERY SYSTEMS FOR BEVERAGE DISPENSING

(75) Inventor: Glyn Jones, Sheffield (GB)

(73) Assignee: Stanwell Technic Limited, Halifax (GB)

( * ) Notice: Subject to any disclaimer, the term of this patent is extended or adjusted under 35 U.S.C. 154(b) by 0 days.

(21) Appl. No.: 12/863,337

(22) PCT Filed: Jan. 16, 2009

(86) PCT No.: PCT/GB2009/050031

§ 371 (c)(1),
(2), (4) Date: May 11, 2011

(87) PCT Pub. No.: WO2009/090429

PCT Pub. Date: Jul. 23, 2009

(65) Prior Publication Data

US 2011/0204089 A1 Aug. 25, 2011

(30) Foreign Application Priority Data

Jan. 16, 2008 (GB) ..... 0800792.4
Jun. 11, 2008 (GB) ..... 0810714.6

(51) Int. Cl.
*B67D 7/06* (2010.01)

(52) U.S. Cl.
USPC ..... 222/23; 222/66; 222/399; 222/152; 222/190; 222/189.06; 222/189.08; 222/129

(58) Field of Classification Search
USPC ..... 222/23, 53, 61, 132, 152, 189.06, 222/189.08, 190, 394, 399, 65, 66, 129, 222/547, 325
See application file for complete search history.

(56) References Cited

U.S. PATENT DOCUMENTS 780,682 A * 1/1905 Posch ..... 55/419
3,591,050 A * 7/1971 Kupersmith et al. ..... 222/23
3,744,537 A * 7/1973 Cole ..... 141/4
3,989,461 A * 11/1976 Skocypec et al. ..... 422/111

(Continued)

FOREIGN PATENT DOCUMENTS

EP 1 690 825 A2 8/2006
GB 1318783 5/1973

(Continued)

OTHER PUBLICATIONS

Int'l Search Report & Written Opinion issued in application No. PCT/GB09/50031 (2009).

(Continued)

*Primary Examiner* — Kevin P Shaver
*Assistant Examiner* — Patrick M Buechner
(74) *Attorney, Agent, or Firm* — Myers Bigel Sibley & Sajovec

(57) ABSTRACT

A gas recovery system for a beverage dispensing system is provided. The system includes a mechanism for drawing gas from an at least partially used beverage container, a compressor downstream of the at least partially used beverage container, a gas separator downstream of the compressor, and a gas storage vessel downstream of the gas separator. The gas recovery system is configured to draw gas from the at least partially used beverage container, to separate the gas into component gases by passing the gas through the gas separator, and to selectively direct at least one of the separated component gases to the gas storage vessel.

27 Claims, 11 Drawing Sheets

(56) References Cited

U.S. PATENT DOCUMENTS

| | | | | |
|---|---|---|---|---|
| 4,364,493 | A * | 12/1982 | Raynes et al. | 222/399 |
| 4,406,382 | A * | 9/1983 | Roth | 222/64 |
| 4,768,347 | A * | 9/1988 | Manz et al. | 62/149 |
| 4,928,850 | A * | 5/1990 | Fallon et al. | 222/3 |
| 5,233,837 | A * | 8/1993 | Callahan | 62/621 |
| 5,565,149 | A * | 10/1996 | Page et al. | 261/140.1 |
| 5,636,763 | A * | 6/1997 | Furness | 222/54 |
| 6,209,567 | B1 * | 4/2001 | Gustafson | 137/170.2 |
| 6,820,763 | B2 * | 11/2004 | Bilskie et al. | 222/61 |
| 6,843,391 | B2 * | 1/2005 | Jones | 222/399 |
| 7,669,438 | B2 * | 3/2010 | Berry et al. | 62/617 |
| 8,322,571 | B2 * | 12/2012 | Hovinen et al. | 222/65 |
| 2002/0088826 | A1 * | 7/2002 | Barker et al. | 222/129.1 |
| 2004/0014825 | A1 * | 1/2004 | Hensman | 518/702 |
| 2004/0026456 | A1 | 2/2004 | Jones | |
| 2005/0129807 | A1 * | 6/2005 | Yuan et al. | 426/8 |
| 2006/0283877 | A1 * | 12/2006 | Bodemann | 222/53 |
| 2007/0031302 | A1 * | 2/2007 | Wittrup et al. | 422/168 |
| 2007/0245698 | A1 * | 10/2007 | Lomax et al. | 55/385.1 |
| 2011/0233230 | A1 * | 9/2011 | Jones et al. | 222/53 |

FOREIGN PATENT DOCUMENTS

| | | | |
|---|---|---|---|
| GB | 2 276 678 | A | 10/1994 |
| NL | 7706025 | | 12/1978 |
| WO | WO 01/94252 | | 12/2001 |
| WO | WO 01/94252 | A2 | 12/2001 |
| WO | WO 2007/053665 | A2 | 5/2007 |

OTHER PUBLICATIONS

European Search Report for EP 13 16 6197; Date of Mailing: Jul. 11, 2013; 6 Pages.

* cited by examiner 14
52
50
A
54
B
Beer Dispense
Line pressure
38 PSIG 14
52
50
54
Beer Dispense
Line pressure
0 PSIG 14
50
52
System Line
pressure
0 PSIG
54
LV
58
Beer Dispense
Line pressure
38 PSIG Co2 Bypass PSA Separation

GAS RECOVERY SYSTEMS FOR BEVERAGE DISPENSING

CROSS-REFERENCE TO RELATED PATENT APPLICATIONS

This application is a U.S. nationalization under 35 U.S.C. §371 of International Application No. PCT/GB2009/050031, filed Jan. 16, 2009, which claims priority to United Kingdom Patent Application Nos. GB 0800792.4, filed Jan. 16, 2008, and GB 0810714.6, filed Jun. 11, 2008, the contents of which applications are herein incorporated by reference in their entireties.

FIELD OF INVENTION

The present invention relates to a liquid dispensing system.

More particularly the present invention relates to a liquid dispensing system for dispensing beer from a large number of containers or kegs, and a gas recovery system for recovering gas from such a beer dispensing system.

BACKGROUND

It is known for pubs and the like to store beer in kegs. The kegs are supplied with gas, typically carbon dioxide or nitrogen or a combination of the two, to maintain a desired pressure in the keg. The pressure within the keg helps to drive the beer to the dispensing tap where the beer is served, and also serves to maintain carbonation in the beer. The composition of gas and pressure used depends upon the pressure required by the particular beer in the keg.

As beer is used up, more gas needs to be pumped into the keg to maintain the required pressure. Typically, once a keg has been fully used up and no longer contains any beer, the keg is removed from the beer supply line and returned to the brewery where residual gas is then vented.

Accordingly, large amounts of gas, particularly carbon dioxide, are required within a beer dispensing system to provide the necessary pressure to the kegs. The greater the number of kegs within the system the greater the amount of gas required.

Typically the gas is stored in tanks which are delivered to the pub or like establishment, and once the tanks are emptied they are returned to the gas provider to be re-filled. Since the gas used by the kegs is usually vented to atmosphere, new deliveries of gas have to be made frequently.

This has a negative impact on the environment, not only because of the carbon dioxide which is directly vented to the atmosphere from the used kegs, but also because of the emissions from the delivery trucks which need to make frequent deliveries.

Accordingly there is a need for a system that can reduce the gas wastage of beverage dispensing systems.

A system that attempts to achieve this is shown in WO 01/94252 (Jones), which shows two embodiments of a gas reclamation system for a beverage dispensing system.

In the first embodiment, gas from a used keg is passed through a separator which separates the gas before passing the separated gas into a collection tank. The separated gas is then passed through a compressor after which it may be re-used by the system.

There are several drawbacks with having the compressor at the last stage as shown in this embodiment of the system. First, having the gas collection tank positioned upstream of the compressor means that only a portion of the gas in the keg will be recoverable, this portion being equal to the balanced pressure between the collection tank and the keg.

To increase the amount of gas recoverable from the keg, the compressor will have to be stopped and started frequently to ensure a pressure differential exists between the keg and the collection tank. This causes very high wear on the compressor which will therefore need to be maintained frequently.

Secondly, in the first embodiment the separator is shown upstream of the compressor. Therefore the gas will pass through the separator at a pressure no greater than the maximum top pressure of the keg, which is typically about 375 kPa (all pressures quoted are absolute pressures). This pressure is not sufficient to ensure complete separation of carbon dioxide and nitrogen from a gas blend mix, since pressures of more than about 500 kPa are typically required to ensure separation when using a gas separation filter.

The second embodiment of the Jones system uses a gas sensor to sense the composition of the gas being reclaimed from the used keg, before passing this gas through a compressor and into a relevant collection tank for that particular composition of gas.

A major drawback of this embodiment is the number of collection tanks that are required i.e. one collection tank per type of gas mix recovered. So if an establishment has a number of different types of beer within the dispensing system each requiring a different gas blend mix, then this same number of storage tanks will be required.

Another major drawback of both embodiments of the Jones system is that it requires a user to disconnect the keg from the beer supply before connecting it to the gas reclamation system. This increases the amount of labour and therefore costs associated with using the system.

It is therefore an object of the present invention to overcome or at least mitigate these and other problems in the prior art.

SUMMARY

Accordingly the present invention provides a liquid dispensing system, a gas recovery system and a keg handling system as set forth in the appended claims.

The liquid dispensing system of the present invention enables beverage containers in the system to be processed with no user intervention during the processing cycle.

The layout of the components of the gas recovery system as claimed results in a very high level of gas recovery and separation since the gas is compressed before being passed through a separator.

In a preferred embodiment the system is fully automatic, meaning that the system can switch between beer dispensing mode and gas recovery mode automatically. In a still more preferred embodiment, once gas has been fully recovered from a used keg the keg is automatically re-pressurised to a pressure of about 170 kPa ready for return of the keg to the brewery or other supplier.

In other words, the present invention discloses a fully automatic system that enables a keg to be connected to a beverage dispensing system, for the keg to be used and the gas recovered, then for the keg to be prepared for return to the brewery with no, or at most minimal, user intervention.

In one embodiment of the gas recovery system the gas separator is preferably in the form of a hollow fibre membrane positioned downstream of the compressor. The hollow fibre membrane element contains pores of a size that are designed to only let gas of a certain composition through. By forcing gas through the hollow fibre membrane under pressure the gas in question is separated into one or a number of component gases as required, after which the component gas or gases are passed to storage tanks prior to return to the system.

In a second embodiment the gas separator is a hollow fibre membrane positioned downstream of the beer keg. Gas is passed through the hollow fibre membrane and the gas contained in the keg is thereby separated.

In a most preferred embodiment, the gas reclamation system comprises a gas blending unit downstream of the at least one storage tank. The gas blending unit can then provide any composition of gas as required e.g. 70% carbon dioxide, 30% nitrogen; 60% carbon dioxide, 40% nitrogen etc.

Accordingly, for most applications only three storage tanks are required: an oxygen tank, a nitrogen tank and a carbon dioxide tank, the gas blending unit being capable of blending the nitrogen and carbon dioxide to any composition. When a gas of a single composition is required then this gas bypasses the gas blending unit.

The present system therefore significantly reduces the number of gas storage tanks required.

A preferred embodiment of the present invention also provides a nitrogen generating mode, thereby eliminating the need to have nitrogen gas tanks delivered. When in nitrogen generating mode the system draws air from the atmosphere and passes it through the gas separator, with the separated nitrogen gas then being delivered to the nitrogen storage tank. Other gases separated during this process, for example oxygen, can be delivered to respective storage tanks as required.

The compressor preferably comprises a sealed download system that allows any gas remaining in the compressor following a recovery cycle to be recycled within the system, which therefore eliminates gas wastage and also prevents stalling of the compressor when a new recovery cycle is begun. To achieve this function the compressor comprises a download vessel into which any gas remaining in the compressor following a gas recovery cycle is fed. When a new gas recovery cycle begins, the gas contained in the download vessel is fed back to the inlet of the compressor and is thus retained within the system.

The present invention also discloses a liquid dispensing system comprising a gas recovery system as claimed, described in more detail below with reference to the drawings.

The present invention also discloses a new design of beverage exhaust detector, which is preferably in the form of a foam on beer (FOB) valve.

A FOB valve is a valve that is positioned in the beer line between the beer keg and the beer tap at which the beer is served. A known FOB valve comprises a chamber having an inlet from a beer keg and outlet to a beer tap. Within the chamber is situated a float, which when the FOB valve chamber contains beer floats above the outlet and therefore allows beer to flow through the FOB valve. When the keg is empty or nearly empty, beer no longer flows through the FOB valve, and is instead replaced by foam. The foam is not dense enough to support the float, which therefore drops into the outlet valve thereby closing the FOB valve. This prevents gas or excessive gas from entering the beer line. Any gas in the FOB valve can then be vented via a vent valve.

For use with a gas recovery system as claimed, a FOB valve is disclosed further having a safety valve in the beer line. This can effectively isolate the FOB valve from the rest of the system.

Preferably, whenever a gas recovery cycle is begun, the FOB valve is isolated from the system. This prevents any pressure differential within the supply line caused by a recovery cycle from lifting the FOB valve float out of the FOB chamber outlet, which could potentially allow unwanted foam into the beer line. The safety valve also prevents any damage occurring to valves within the keg itself or the keg tapping head connector.

BRIEF DESCRIPTION OF DRAWINGS

Other aspects and preferred features of the invention are described below with reference to the accompanying drawings in which.

DETAILED DESCRIPTION

Figure 1:
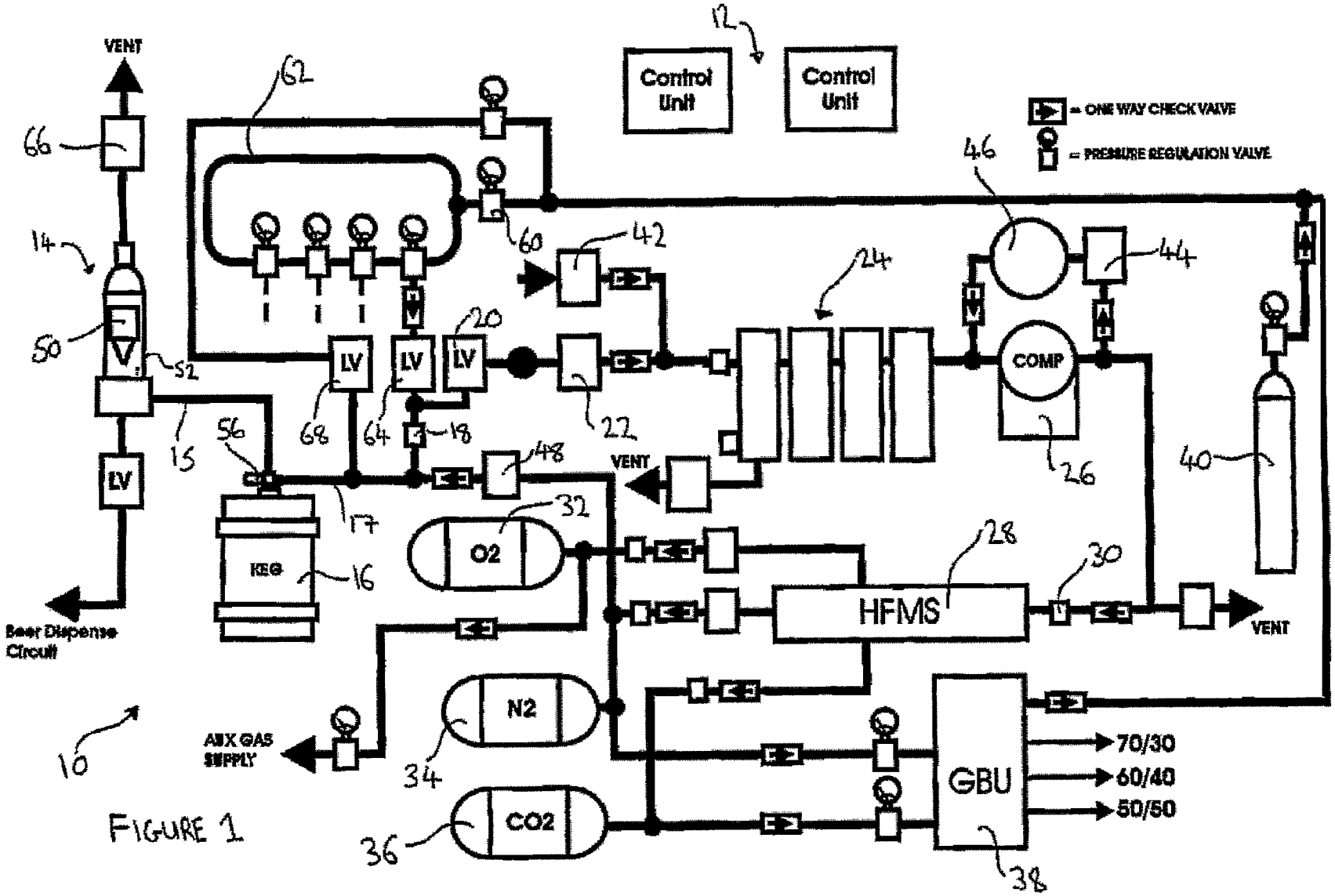
FIG. 1 is a schematic view of a liquid dispensing system incorporating a gas recovery system as claimed.

In FIG. 1, a liquid dispense system incorporating a gas recovery system according to the present invention is shown generally at 10. Beer is drawn from a keg 16 along beer line 15, and gas may be supplied to the keg and removed from the keg along gas line 17. For clarity only a single keg is shown, but it should be understood that multiple kegs may be connected to such a gas recovery system.

A gas recovery operation will now be described with reference to FIG. 1. The beverage dispense system has a central control unit 12. Once the central control unit 12 has received a signal from a foam on beer (FOB) valve 14 to indicate that a keg 16 is used i.e, no longer contains any beer, pressure sensor 18 checks to see if there is sufficient pressure in the keg for a gas recovery cycle. If pressure sensor 18 detects that there is enough pressure, then valve 64 is closed turning off the gas supply to the keg, and valves 20 and 22 (means for drawing) are opened to allow gas from the keg 16 to enter the gas recovery system. The gas then passes through a filter shown generally at 24 (and described in more detail with respect to FIG. 9) before entering a compressor 26.

The gas is compressed in compressor 26 and subsequently forced through hollow fibre membrane 28 under pressure. A pressure sensor 30 is positioned between the compressor and hollow fibre membrane to detect when the hollow fibre membrane becomes blocked and requires maintenance.

Once the gas has entered the membrane it is forced through pores contained within membrane elements which separates the incoming gas into one or a number of component gases.

The component gases are then directed to their respective storage tanks. In this exemplary embodiment the gas recovery system contains an oxygen storage tank 32, a nitrogen storage tank 34 and a carbon dioxide storage tank 36.

The recovered gases are then ready to be re-used by the system.

Usually beers are supplied with a gas mixture to provide the necessary pressure. To provide the necessary mixture, the required gases are passed through the gas blending unit 38, after which the gas mixture can be returned to the system for use. If a single gas is required, for example 100% carbon dioxide, then gas will only be drawn from the carbon dioxide storage tank and no blending of gases will occur.

An additional gas supply tank 40 is positioned downstream of the gas blending unit. This additional tank is used to top up the system with additional gas if insufficient gas has been recovered due to losses of any kind in the gas recovery system. Since the present invention provides very high recovery rates of gases, then gas will only rarely be drawn from the additional tank 40.

The gas recovery system of the present invention also has a nitrogen generating mode. When in nitrogen generating mode, air from the atmosphere is drawn through filter 42 and subsequently follows the gas recovery path as described above. Once the air has passed through the hollow fibre membrane 28, it is primarily split up into nitrogen and oxygen which are then passed on to their respective storage tanks. These recovered gases can then be used by the system. Any oxygen stored in the oxygen storage tank is used to run any gas driven devices within the system. This prevents wastage of oxygen.

The sealed download function of the compressor, which further increases the efficiency of the system and reduces gas wastage, operates as follows. Once all gas has been recovered from keg 16, valves 20 and 22 are closed thus isolating the compressor 26 from the keg. Once these valves are closed, valve 44 is opened by the control unit 12 which allows any remaining gas in the compressor 26 to be downloaded into download vessel 46. Once a new recovery cycle is started, any gas in the download vessel 46 is returned to the gas recovery circuit to be processed.

Once a keg 16 has been fully emptied of beer and all gas recovered, the keg is automatically re-pressurised to approximately 170 kPa for return to the brewery or keg supplier. In this example, once the control unit 12 receives a signal that the gas recovery process has been completed, valve 48 is opened and nitrogen from storage tank 34 is fed back into the keg 16 until the required pressure has been reached. The control unit will then order a signal that tells a user that the keg is ready to be removed.

Another feature of the present invention is FOB valve 14. A known FOB valve is shown in FIGS. 2 and 3.

Figures 2, 3, 4:
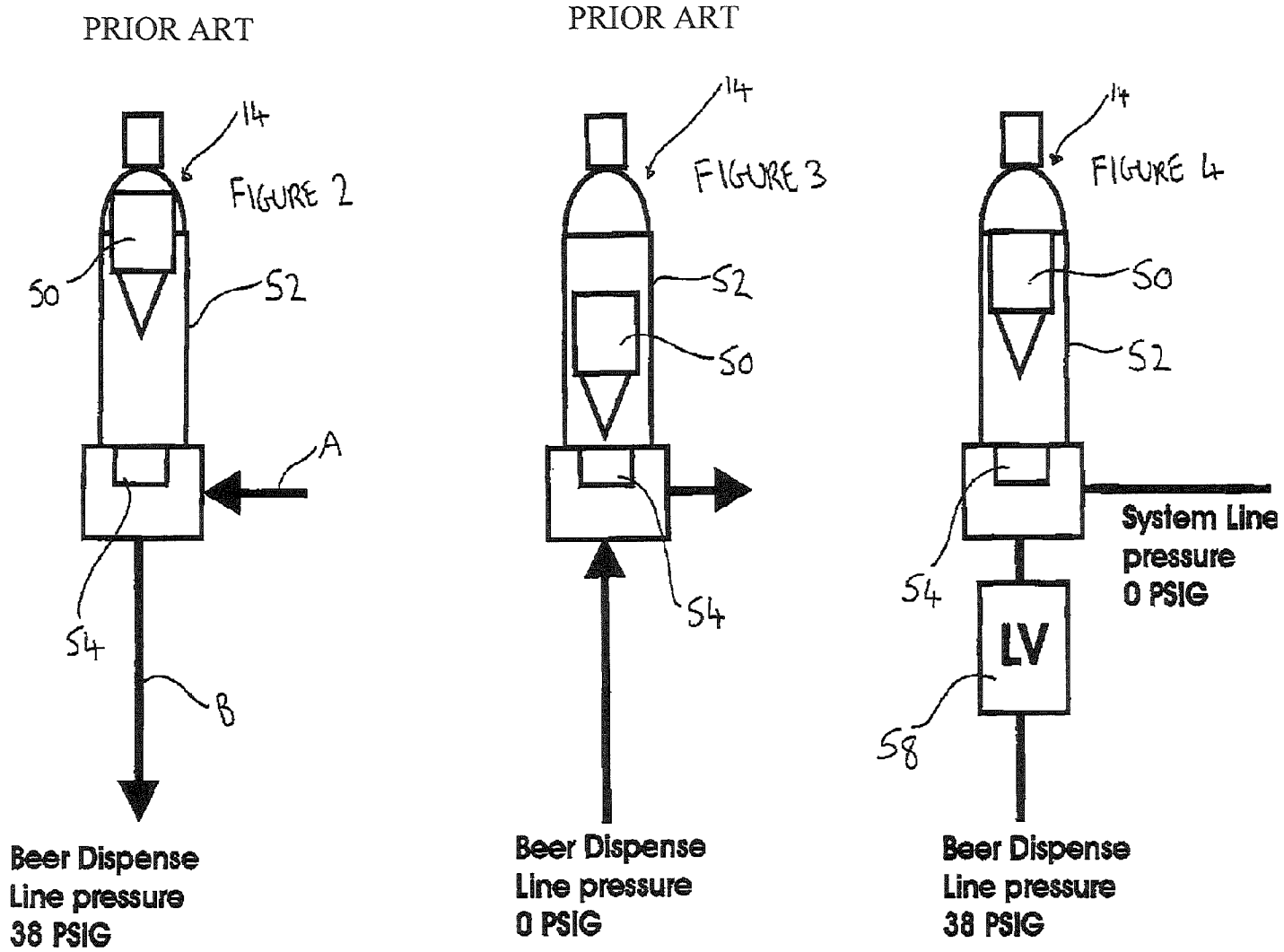
PRIOR ART FIGURE 2
PRIOR ART FIGURE 3
FIGS. 2 and 3 show a known type of foam on beer valve.
FIG. 4 shows a novel foam on beer valve incorporating a safety valve.

In FIG. 2, beer is shown entering the FOB valve in the direction of arrow A, and beer is shown exiting the FOB valve in the direction of arrow B. In FIG. 2, the keg still has beer remaining in it which causes float 50 to float within chamber 52. The float is therefore held above an outlet 54 and beer can flow through the beer line.

When the keg runs out of beer, foam enters the FOB valve thus causing float 50 to drop within the chamber 52 and close off outlet 54, thereby preventing foam from entering the beer line.

FIG. 3 shows a potential consequence of a keg tapping head connector 56 failing during a gas recovery cycle. As gas is drawn out of the keg 16 a vacuum or partial vacuum is created in the beer line thus causing float 50 to be lifted out of outlet 54, thus allowing foam and gas to enter the beer line, and potentially damage to be caused to the keg tapping head connector 56.

This problem is overcome by the addition of a safety valve 58 to the beer line, which may be closed during a gas recovery cycle so as to isolate the FOB valve 14 from the gas line 17. This prevents the FOB valve from being opened during gas recovery.

Figure 5:
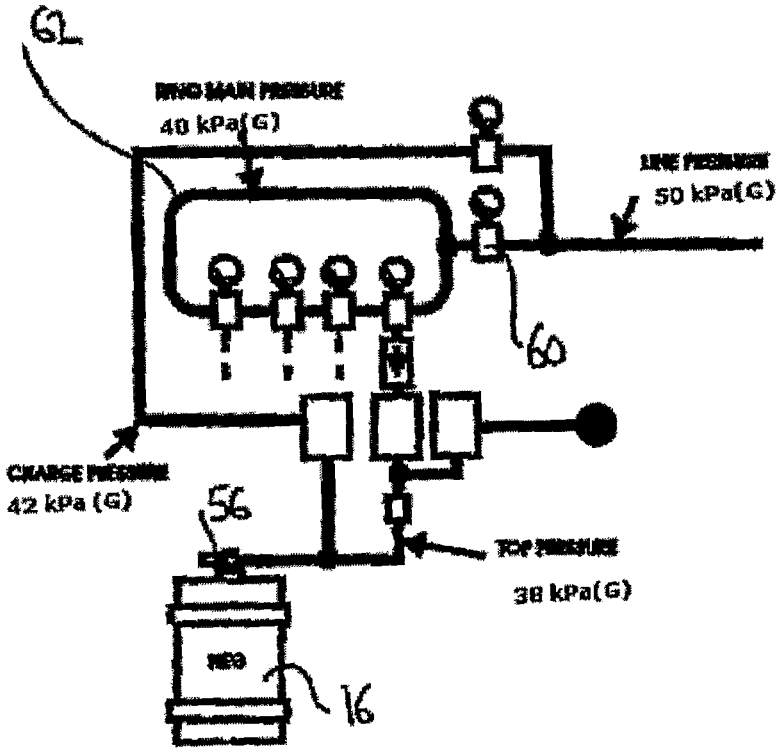
FIG. 5 is a schematic diagram showing the normal pressure levels in a gas circuit according to the present invention.
Figure 6:
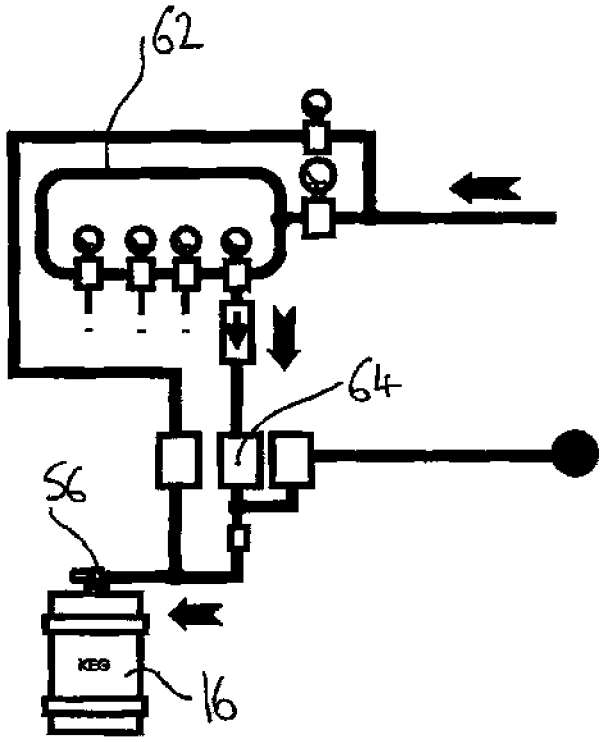
FIG. 6 is a schematic diagram showing a gas circuit according to the present invention during supply of gas to a keg.
Figure 7:
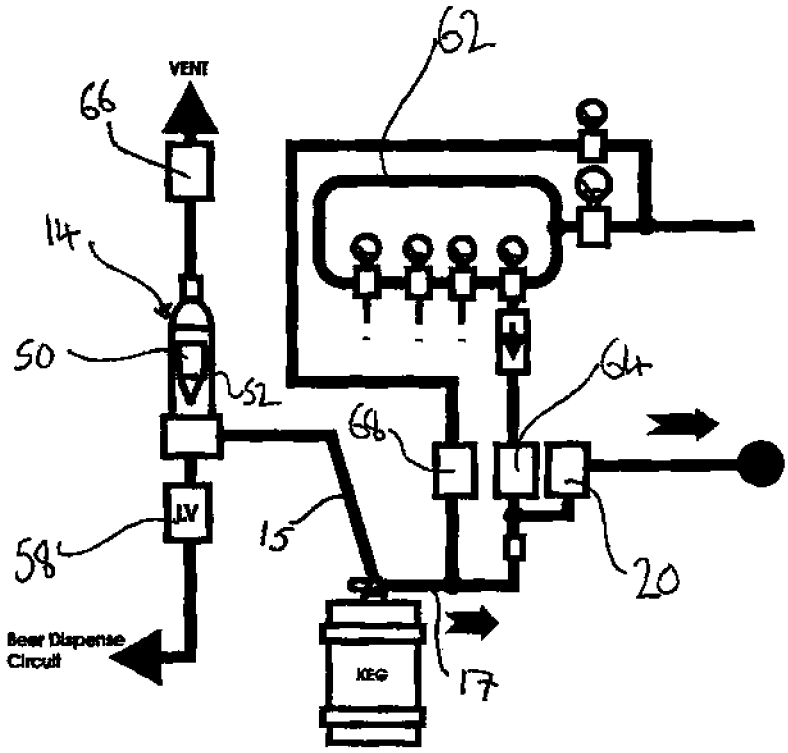
FIG. 7 is a schematic diagram showing a gas circuit according to the present invention during recovery of gas from a keg.

FIGS. 5, 6 and 7 are detailed views of parts of the beer dispense and gas recovery circuit of FIG. 1, and show pressure levels within the gas supply and recovery circuit during various stages of gas supply and gas recovery.

FIG. 5 shows the normal pressure levels found in the gas circuit. The line pressure of the supply gas is set to 445 kPa and then reduced to 375 kPa via pressure reducing valve 60. The supply then enters the gas ring main 62 and the pressure is reduced again to somewhere between about 238 kPa and 362 kPa depending on the type of beer present in the keg 16.

FIG. 6 shows supply of gas to the keg 16 during a normal beer dispense function. When the keg requires additional pressure, gas flows through valve 64 thereby allowing gas from the gas ring main 62 to flow into the keg 16 via keg tapping head connector 56.

FIG. 7 shows a view of certain parts of the gas circuit during a gas recovery operation. Once the control unit 12 has received a signal from the FOB valve 14 that the keg 16 no longer contains any beer, the control system opens vent valve 66 for about five seconds to vent the FOB valve of any gas. FOB valve 14 is then isolated from the gas circuit by closing safety valve 58.

Valves 64 and 68 are then closed and valve 20 is opened allowing the gas to be passed to the main system for the gas recovery cycle to continue as described above with reference to FIG. 1.

Figure 8:
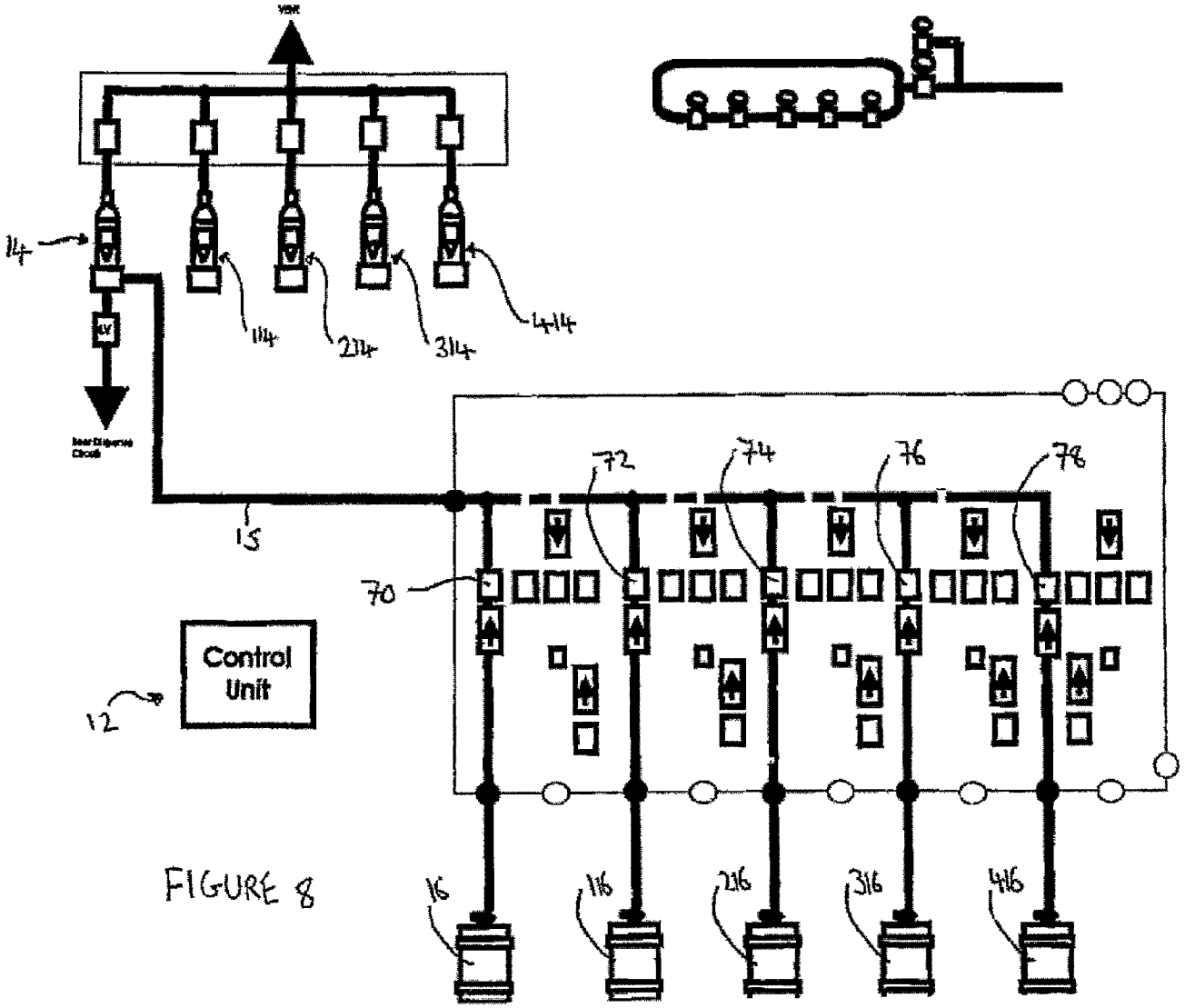
FIG. 8 is a schematic diagram showing the automatic change over valve system according to the present invention.

FIG. 8 shows kegs 16, 116, 216, 316 and 416 connected to a liquid dispensing unit and gas recovery system according to the present invention, with certain features removed from the drawing for clarity. FIG. 8 shows how the automatic change over valve system works to allow the system to check when kegs are used and therefore either need removing from the system or require a gas recovery cycle, and which kegs still contain beer and therefore may remain connected to the beer line. The automatic change over valve system allows the beverage dispensing system to switch between kegs as they are used up.

Each keg 16, 116, 216, 316 and 416 is respectively connected to a FOB valve 14, 114, 214, 314 and 414, although for ease of understanding only one of these connections is shown in FIG. 8. When the control unit 12 receives a signal from the FOB valve 14 indicating that keg 16 is empty, the FOB valve will undergo a venting and isolation procedure as described above with reference to FIG. 4. Control valve 70 will then be closed, thus disconnecting the keg 16 from the beer line 15.

Control valve 72 is subsequently opened to connect keg 116 to the beer line. If FOB valve 114 senses that keg 116 is also fully used, then the control unit 12 will close valve 72 to disconnect keg 116 from the beer line, and open valve 74 to connect keg 216 to the beer line. This process is continued through use of FOB valves 314 and 414 and control valves 76 and 78 until the system finds a keg still containing beer. It should be appreciated that this system is suitable for any number of kegs.

The control unit 12 will indicate to a user when a beer keg is used, all gas has been recovered, and the keg re-pressurised so that it can be removed from the system and replaced by a fresh keg.

Figure 9:
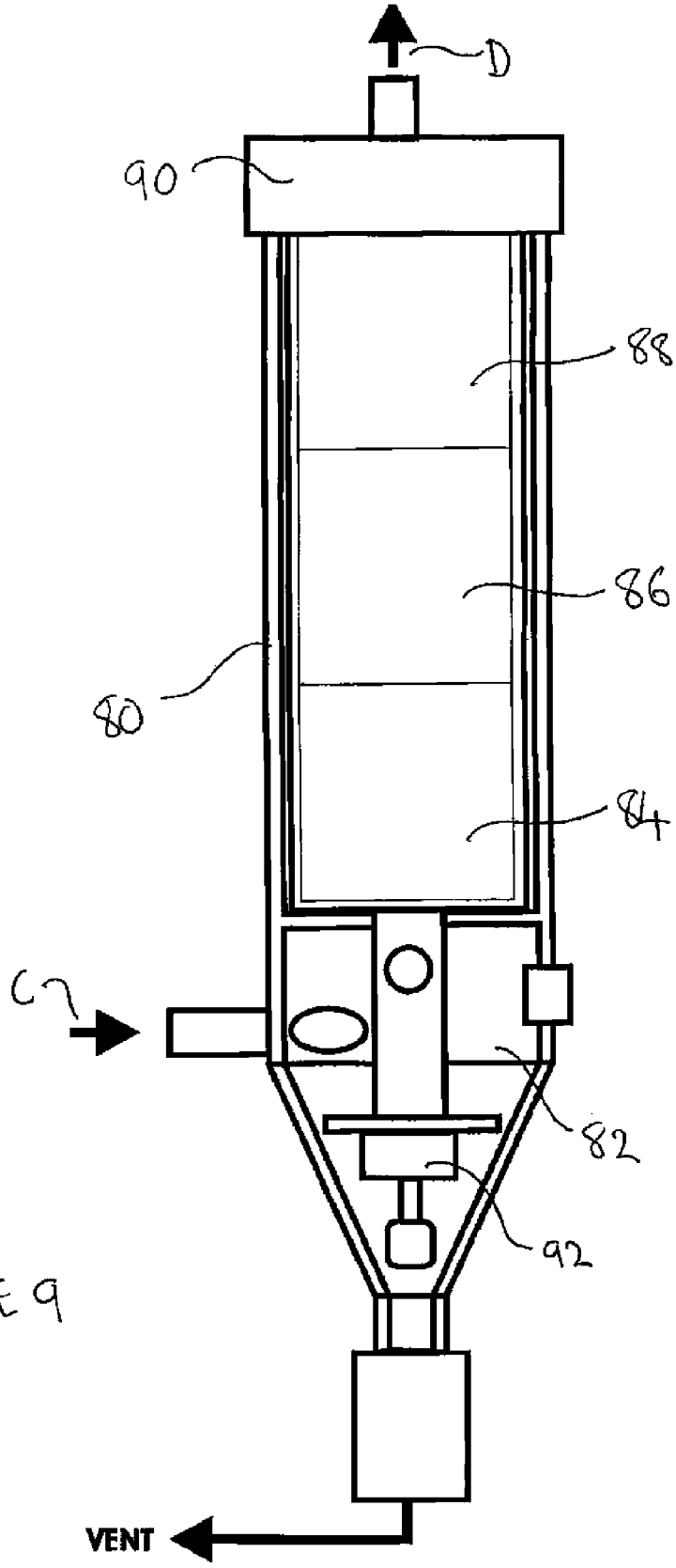
FIG. 9 is a detailed view of a filter as used in the gas recovery system according to the present invention.

FIG. 9 shows in detail filter unit 24 which is positioned upstream of compressor 26. The filter unit comprises a main housing 80, within which are contained filter elements 82, 84, 86 and 88. The end of the filter unit is closed off with a lid 90.

Gas enters the filter unit in the direction of arrow C and leaves the filter in the direction of arrow D.

Recovered gas first passes through moisture removal element 82 to remove moisture from the gas stream. The filter unit also has a moisture sensor 92 that will indicate to an operator via an alarm if the gas stream contains excessive moisture, which may occur in the event of the keg 16 being stored incorrectly, for example in a non-upright position.

The recovered gas then passes through a molecular sieve element 84 which removes any further moisture or alcohols remaining in the gas, and then through an absorbent filter element 86 which removes any hydrocarbons in the gas. The recovered gas then passes through polishing filter element 88 which removes any other contaminants remaining in the system. The filtered gas is then passed on to the compressor for the continuation of the gas recovery cycle.

It should be appreciated that it is also possible for the filter to comprise the above features separately and not within a single housing.

Figure 10:
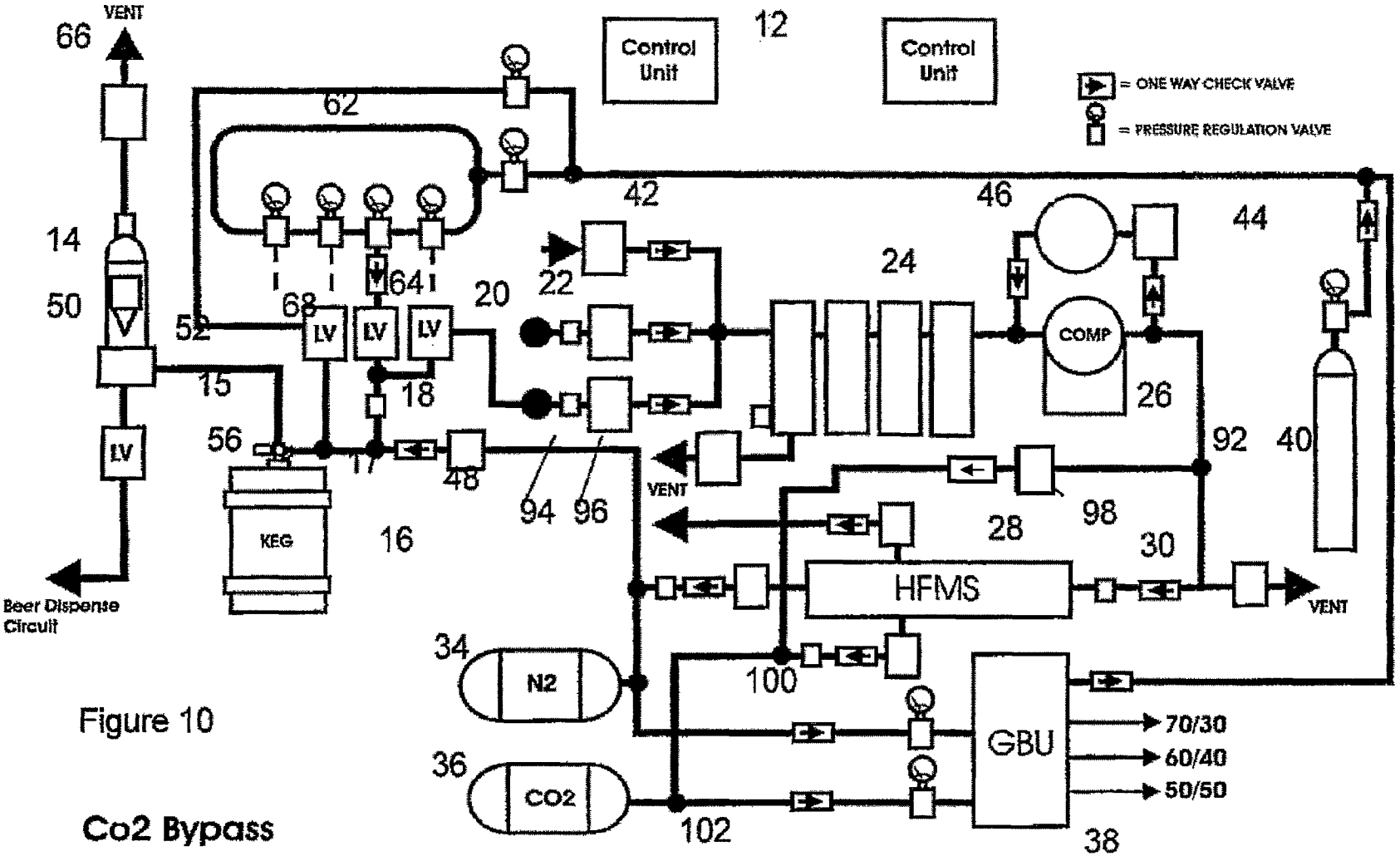
FIG. 10 is a schematic view of a liquid dispensing system in a further embodiment with a $CO_2$ bypass.

FIG. 10 is a schematic view of a liquid dispensing system with many of the features described previously with reference to FIG. 1 with the addition of a $CO_2$ bypass. There is shown the central control unit 12, FOB valve 14, beer line 15, keg 16, gas line 17, pressure sensor 18, valves 20 and 22, filter 24, compressor 26, hollow fibre membrane 28, pressure sensor 30, nitrogen storage tank 34, carbon dioxide storage tank 36, gas blending unit 38, additional tank 40, valves 44 and 48, download vessel 46, a float 50, float chamber 52, keg tapping head connector 56, gas ring main 62 and valves 64 and 68. Furthermore, there is shown the features of the $CO_2$ bypass pressure sensor 94, valves 96 and 98 and junctions 92, 100 and 102. Valve 98 is situated in the connection between junctions 92 and 100 and defines the bypass of the hollow fibre membrane 28.

The system and features are as described previously with reference to FIG. 1. In addition the system has a $CO_2$ bypass feature that allows $CO_2$ to be passed directly to the $CO_2$ storage tank 36 instead of passing through the hollow fibre membrane 28. In a preferred embodiment the system has two inputs one for mixed gases and one for $CO_2$. The presence of $CO_2$ is detected, preferably at $CO_2$ inlet port via pressure sensor 94 and the valves not used in the $CO_2$ recovery are shut down. Therefore, only valves 96, and 98 remain open. The gas in filtered at the filter 24 as described in the detail above with reference to FIG. 1 and flows from the compressor 26 to junction 92 through valve 98 to junction 100, thereby allowing the gas to bypass the hollow fibre membrane 28. The gas flows from junction 100 to junction 102 and is passed to the $CO_2$ storage tank 36. In further embodiments gasses other than $CO_2$ bypass the hollow fibre membrane 28, and are passed directly to their own storage tank in the method as described above. The direct recovery of $CO_2$ is however preferential over other gasses in beverage dispensing systems.

Figure 11:
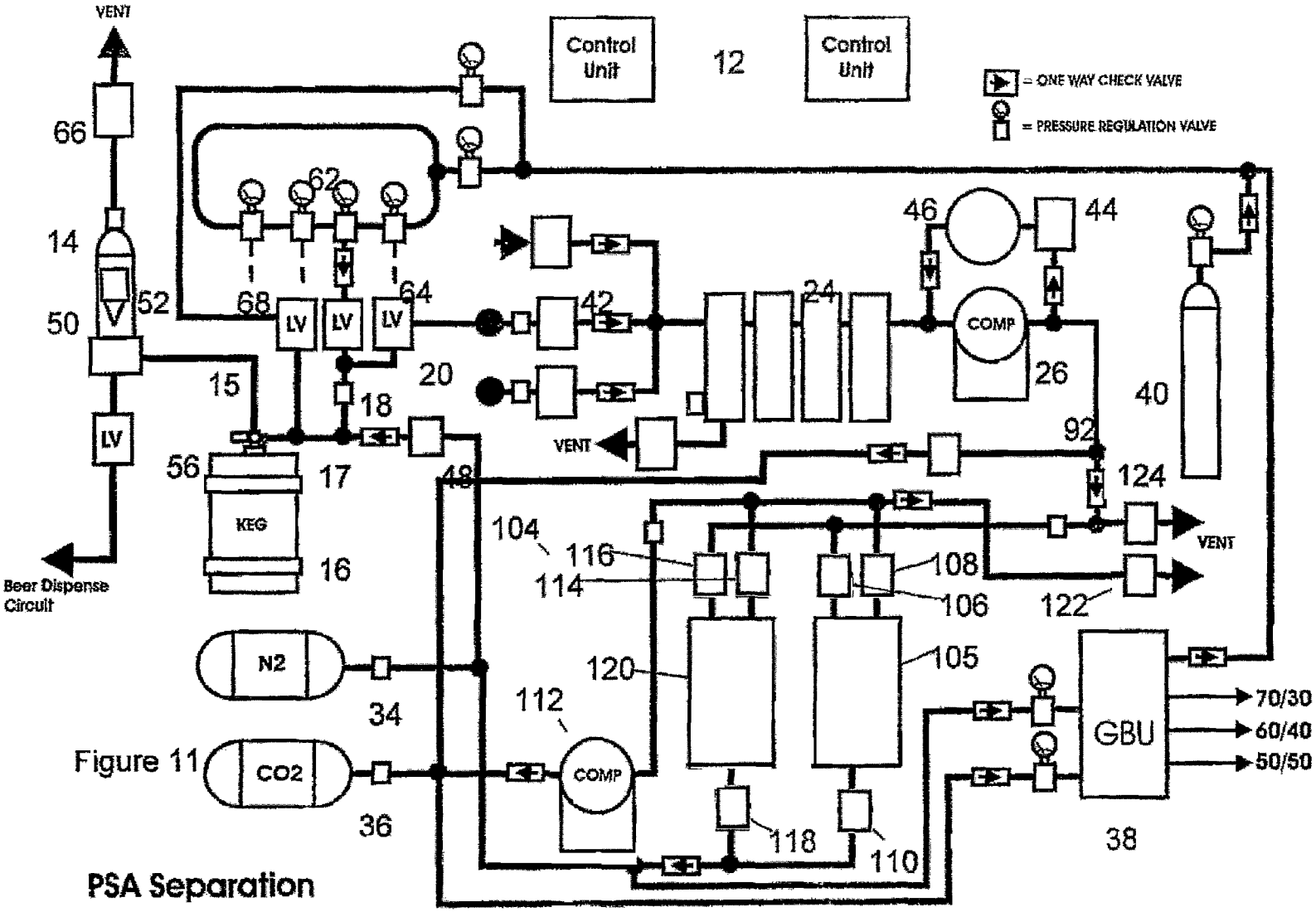
FIG. 11 is a schematic view of a liquid dispensing system in a further embodiment with a Pressure Swing Absorption separator.

FIG. 11 is a schematic view of a liquid dispensing system in a further embodiment with a Pressure Swing Absorption or PSA separator 104. There is shown the central control unit 12, FOB valve 14, beer line 15, keg 16, gas line 17, pressure sensor 18, valve 20, filter 24, compressor 26, nitrogen storage tank 34, $CO_2$ storage tank 36, gas blending unit 38, additional tank 40, valves 44 and 48, download vessel 46, a float 50, float chamber 52, keg tapping head connector 56, gas ring main 62 and valves 64 and 68 and junction 92. Furthermore there is shown valves 106, 108, 110, 114, 116 and 118, PSA cylinders 105 and 120, compressor 112, vent valve 122 and the inlet 124. In use the gas flows to junction 92 and passes through inlet 124, from where it is directed towards the PSA separator 104.

FIG. 11 shows a further embodiment of the invention which incorporates a PSA type separator in place of the hollow fibre membrane 28. The PSA separator 104 may be used when taking into account cost and purity considerations.

In the example shown in FIG. 11 the PSA separator 104 incorporates the $CO_2$ bypass as described with reference to FIG. 10. The PSA separator 104 is one that is known in the art. Those skilled in the art will appreciate that the PSA separator 104 may be used in conjunction with other liquid dispensing systems such as the system as described with reference to FIG. 1.

In an embodiment, the system functions $CO_2$ retrieval mode. $CO_2$ is detected and directed to junction 92 as described with reference to FIG. 10 and valves 108, 114, 116 and 118 are closed and valves 106 and 110 are open. In $CO_2$ retrieval mode, the compressor 26 pressurises the system for a pre-determined length of time, preferably until the system is sufficiently pressurised to dispense beverages at the required pressure. After such length of time valves 106 and 110 are closed and the compressor 26 stops. After another pre-determined length of time, in a preferred embodiment approximately 10 seconds, valve 108 opens and the compressor 112 starts. The contents of PSA separator 104 are emptied into the $CO_2$ storage tank 36, and after a predetermined time period the system stops the compressor 112 and closes valve 108. Preferably during operation if gas pressure is still detected at the inlet of the system 124 the two PSA cylinders 105 and 120 operate on a "one on one off" bases, i.e. when one cylinder is being pressurised the other one will be depressurised in order to provide a continuous stream of gas. This arrangements has the advantage of ensuring that there is little or no wait period in the system during normal running mode.

In a further embodiment the system operates in $N_2$ retrieval mode. In this embodiment PSA cylinder 105 is being filled, the compressor 26 starts up along and the air inlet valve 124 is opened. Valves 108 and 110 are closed and valve 106 is opened thereby filling PSA cylinder 105, though in further embodiments other PSA cylinders may be filled. The compressor 26 runs for a pre-determined period of time dependent on the pressure required in system and then stops, whereupon valve 106 is closed. After another pre-determined length of time, in a preferred embodiment 10 seconds, the vent valve 122 is opened until the pressure in the PSA cylinder 105 has reached atmospheric pressure, whereupon the vent valve 122 is closed. As with the recovery mode described previously, if a predetermined level has not been reached in the $N_2$ storage tank 34 the system can operate the two PSA storage cylinders 105 and 120 in the "one on one off" mode as described previously with reference to the $CO_2$ bypass mode.

In further embodiments the PSA separator 104 may comprise any number of PSA cylinders 105,120 and the gases recovered from such a system need not be limited to $CO_2$ and $N_2$.

Figure 12:
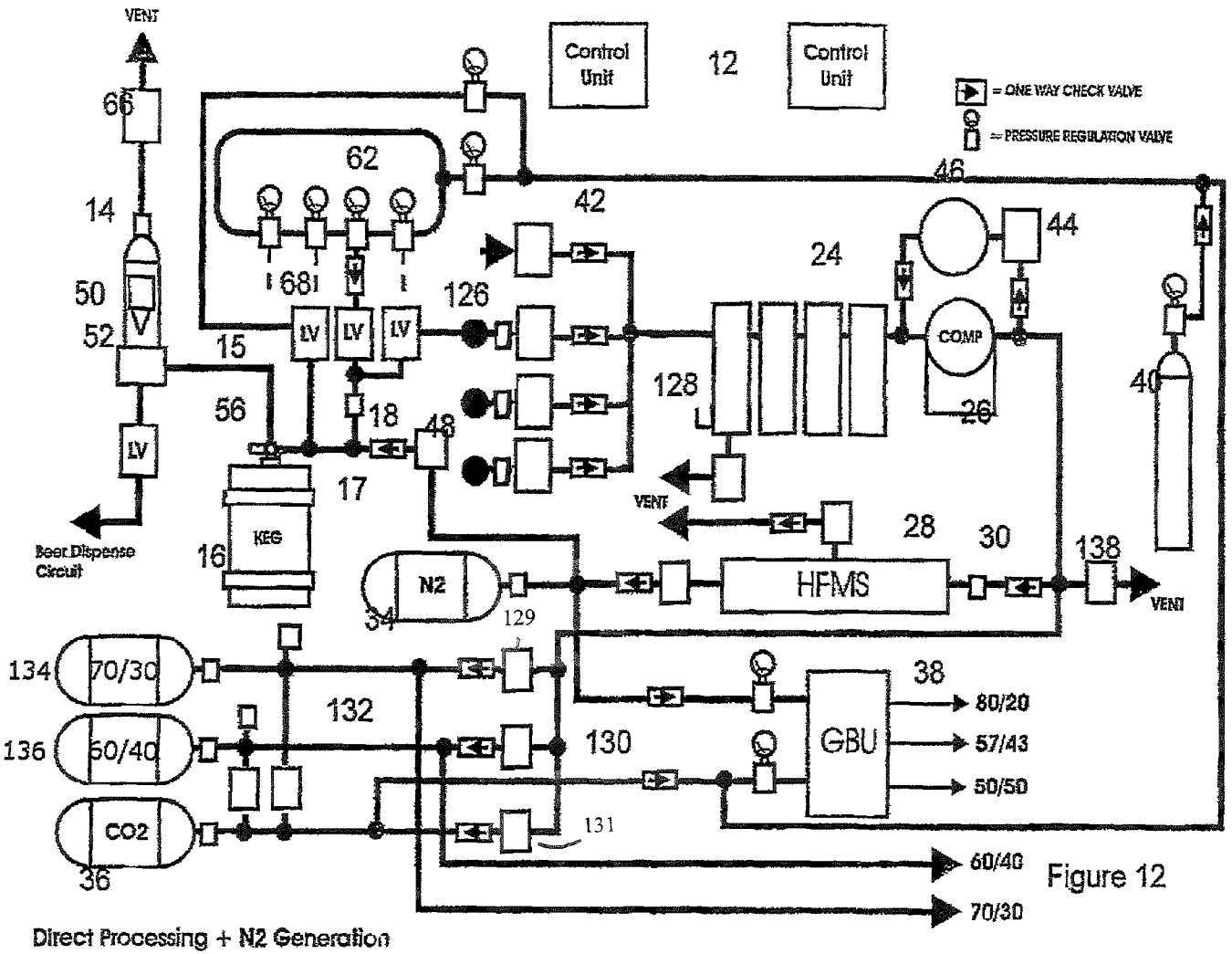
FIG. 12 is a schematic view of a liquid dispensing system in a further embodiment with direct processing of the gas and $N_2$ generation.

FIG. 12 is yet another embodiment of a liquid dispensing system with direct gas processing and $N_2$ generation. In this embodiment, the gas is processed directly from the keg, thereby avoiding the need of a hollow fibre membrane 28 or PSA separator 104. There is shown the central control unit 12, FOB valve 14, beer line 15, keg 16, gas line 17, pressure sensor 18, filter 24, compressor 26, nitrogen storage tank 34, carbon dioxide storage tank 36, gas blending unit 38, additional tank 40, valves 44 and 48, download vessel 46, a float 50, float chamber 52, keg tapping head connector 56, gas ring main 62 and valves 64 and 68. Furthermore there is shown, inlets 126 that are connected to filters 128, valves 129, 130, 131 which are connected to gas sensors 132 which are connected to a 70/30 mixture tank 134, a 60/40 mixture tank 136.

and junction 138. In use the gas flows from the compressor 26 to junction 138. The gas is directed from junction 138 to the valves 130, thereby bypassing the hollow fibre membrane 28.

In this embodiment the gas is directly processed from the keg 16 and does not require the need of a hollow fibre membrane 28 or a PSA separator 104 (not shown in FIG. 12). In a preferred embodiment there are three inlets 126 each connected to a specific gas mixture e.g. 70.30, 60/40 or $CO_2$, though in other embodiments there may be more than or less than 3 inlets dependent on how many gas mixtures there are to be filtered. In a preferred embodiment the present invention will only filter one type of gas that is passed through the inlets 126 at a time. The inlets 126 in the preferred embodiment are fitted with sensors so that the type of gas being filtered may be determined. Once the gas type has been determined the system only processes said gas type and filters the gas to the corresponding storage tank. For example, if the inlet 126 was to detect a 70/30 mixture, the filters 128 would only pass the 70/30 mixture through and the values 129 and pressure sensors 132 would open and valves 130, 131 would shut, thereby directing the gas to the 70/30 storage tank 134. For the recovery of other gases valves 129, 130 and 131 would open and shut as required to direct the gas to the desired storage tank. Those skilled in the art will appreciate that the gas sensors 132 act as an additional fail-safe in only allowing the correct gas type to the tanks 134, 136 and 36. In other embodiments other gas types may be recovered and a varying number of inlets 126 may be used.

In a preferred embodiment the gas sensors 132 are $CO_2$ gas sensors and are used to detect the level of $CO_2$ in the storage tanks 134, 136 and 36. The detection of the levels of $CO_2$ in the system is important, as beverage dispense gases, namely $CO_2$, are consumed in small quantities by the beer in which the gases come into contact with. Therefore, over a period of time if the gas blends are not checked, the system will eventually loss the blend ratio of the gases as the levels of $CO_2$ will vary. When the gas sensors 132 have detected an anomaly in the blend ratio of the gases remedial action to return the blends to the desired ratios is undertaken. The present invention provides a method for ensuring that the levels of gases in a blend are at the correct ratio and maintains them at these ratios.

In further embodiments the system will also have a hollow fibre membrane 28 or PSA separator 104 to generate $N_2$ and will also have a gas blender unit 38 to make all possible gas blends required for dispense.

Figure 13:
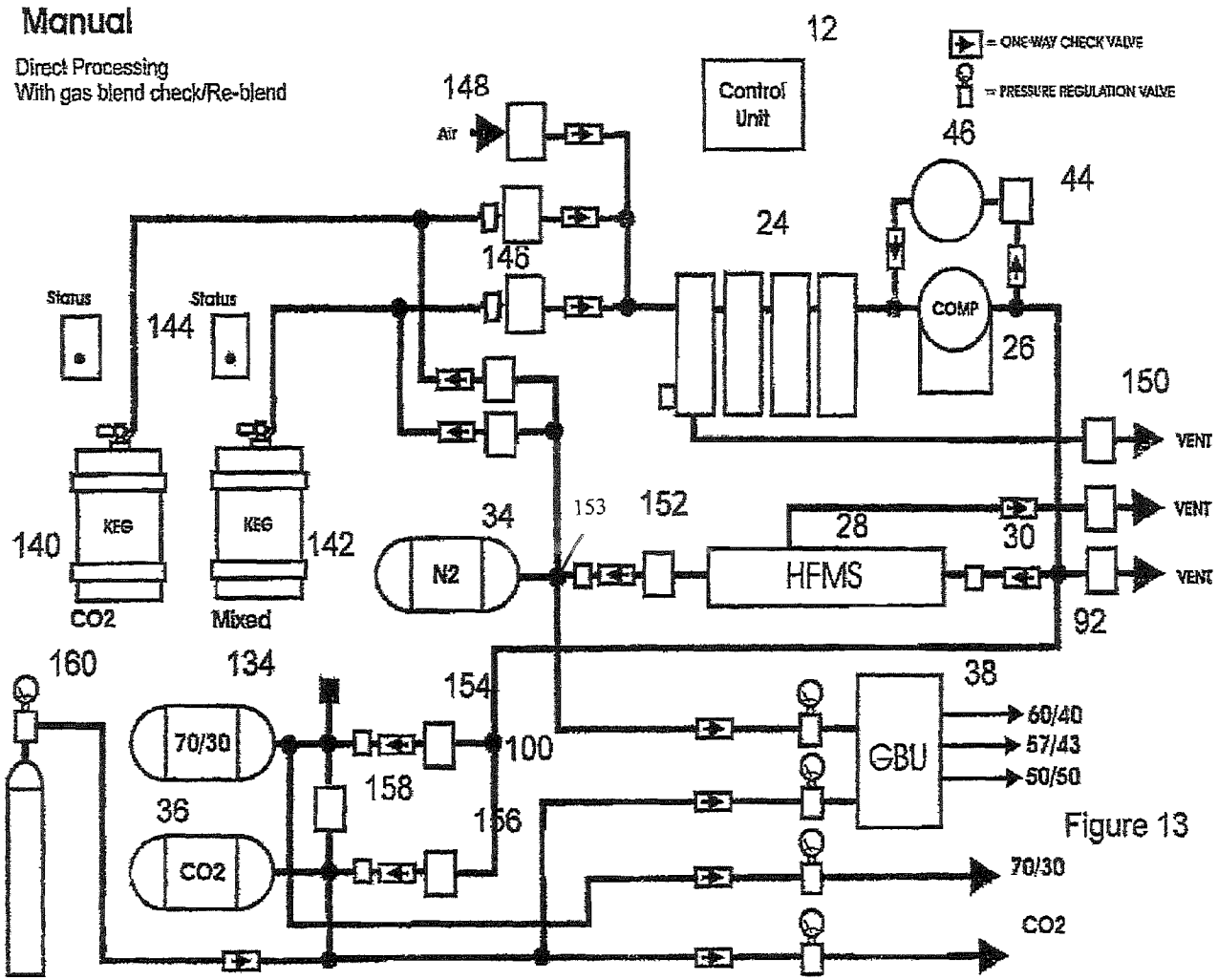
FIG. 13 is a schematic view of a liquid dispensing system in according to further embodiments disclosed herein.

FIG. 13 shows a gas recovery system which is not coupled to a drinks dispensing system. In this embodiment the gases are recovered directly from the keg and may act as a standalone system from which gas may be recovered from empty kegs. There is shown the central control unit 12, filter 24, compressor 26, hollow fibre membrane 28, nitrogen storage tank 34, carbon dioxide storage tank 36, gas blending unit 38, valves 44, download vessel 46, junctions 92, 100, a 70/30 mixture tank 134.

Furthermore, there is shown the kegs a $CO_2$ keg 140 and a mixed keg 142, a keg status indicator 144, valves 146 that are connected to the $CO_2$ keg 140 and a mixed keg 142, and an air input 148. There is also shown the vents 150, attached to the hollow fibre membrane 28, filter 24 and compressor 26. A valve 152 coupled to the hollow fibre membrane 28 further valves 154 and 156 connected to the 70/30 mixture tank 134 and $CO_2$ storage tank 36 respectively and a further valve 158 that separates the connection between the 70/30 mixture tank 134 and $CO_2$ storage tank 36.

In use, the kegs are attached to the gas recovery system. Preferably, there is a status indicator 144 so that a user is able to see how much gas is left in the kegs. In the following example of the embodiment there are two kegs that are connected to the system a $CO_2$ keg 140 and a mixed keg 142. The gas flows directly to a valve 146 which is preferentially a one-way check valve. There is also an air input 148 which draws air from the atmosphere to provide nitrogen. The gas is passed through the filter 24, as described above with reference to FIG. 1. Some gas may be vented at this stage through vents 150. The gas which passes through the filter 24 is compressed at the compressor 26 and flows through the pipe to junction 92. As in the embodiment described above with reference to FIG. 10, the pipe between junctions 92 and 100 define the hollow fibre membrane 28 bypass. In the embodiment shown in FIG. 13, the gas may be passed through the hollow fibre membrane 28 and through valve 152 to junction 153 where dependent on which gas is being filtered is either recycled back into the system through valves 146 or stored in the nitrogen storage tank 34. Those skilled in the art will appreciate that the gas stored need not be nitrogen but is dependent on the structure of the membrane.

In a further embodiment the gas recovery system works in the same way as the $CO_2$ bypass as described with reference to FIG. 10. In such an embodiment, dependent on which gas has been detected either valve 154 or 156 is opened. If 70/30 gas has been detected valve 154 is opened and valve 156 is closed and the gas passes directly to the 70/30 storage tank 134. Likewise if $CO_2$ has been detected valve 156 is opened and valve 154 is closed and the gas flows directly to $CO_2$ storage tank.

Those skilled in the art that whilst the gas recovery system has been described with reference to a $CO_2$ bypass such an embodiment may include all other embodiments described within the specification, with the hollow fibre membrane 28, a PSA separator 104 or direct processing.

Also disclosed is an automatic keg handling system comprising a controller or control unit that is configured to communicate with a beverage exhaust detector and beverage container to order a gas recovery system to begin to recover gas from the beverage container once the beverage has been used up.

Preferably the gas recovery system is of the type described herein in relation to the present invention, but the automatic keg handling system could potentially be fitted to an existing type of gas recovery system.

Preferably the beverage exhaust detector is a foam on beer valve as described with reference to FIG. 4.

The invention claimed is:

1. A gas recovery system for a beverage dispensing system, the gas recovery system comprising:

means for drawing gas from an at least partially used beverage container;

a compressor downstream of said at least partially used beverage container;

a gas separator downstream of said compressor;

a gas storage vessel downstream of said gas separator;

a foam on beer valve; and a controller, wherein upon receiving a signal from the foam on beer valve that the at least partially used keg is fully used, the controller orders a gas recovery cycle to begin, wherein in use the gas recovery system is configured to draw gas from the at least partially used beverage container and to separate said gas into component gases by passing said gas through said gas separator, and to selectively direct at least one of the separated component gases to said gas storage vessel, and wherein upon completion of the gas recovery cycle from the at least partially used beverage container the at least partially used beverage container is automatically re-pressurised.

2. A system as set forth in claim 1 wherein the at least partially used beverage container is re-pressurised to approximately 170 kPa.

3. A system as set forth in claim 1 wherein the gases are supplied to the gas separator at a pressure above 500 kPa.

4. A system as set forth in claim 1 comprising separate nitrogen and/or oxygen and/or carbon dioxide storage vessels.

5. A system as set forth in claim 4 in which the system has a nitrogen generating mode.

6. A system as set forth in claim 1 comprising a filter positioned upstream of said compressor.

7. A system as set forth in claim 6 wherein said filter comprises a moisture removal filter.

8. A system as set forth in claim 6 wherein said filter comprises a molecular sieve for removing moisture and alcohol from the gas.

9. A system as set forth in claim 6 wherein said filter comprises an absorbent filter bed for removal of hydrocarbons.

10. A system as set forth in claim 6 wherein said filter comprises a polishing type filter for removal of contaminants.

11. A system as set forth in claim 6, wherein the filter comprises a moisture removal filter, a molecular sieve, an absorbent filter bed and a polishing type filter contained within a single housing.

12. A gas recovery system as set forth in claim 1 wherein the gas separator comprises a pressure swing absorption gas separator.

13. A gas recovery system for a beverage dispensing system, the gas recovery system comprising:

means for drawing gas from an at least partially used beverage container;

a compressor downstream of said at least partially used beverage container;

a gas separator downstream of said compressor, a gas storage vessel downstream of said gas separator, a foam on beer valve; and wherein in use the gas recovery system is configured to draw gas from the at least partially used beverage container and to separate said gas into component gases by passing said gas through said gas separator, and to selectively direct at least one of the separated component gases to said gas storage vessel, and wherein the foam on beer valve comprises: a housing defining a chamber;

a channel positioned at a base of said chamber to allow for dispense of beverage;

a float disposed within said chamber to selectively close the channel;

the foam on beer valve further comprising an isolation control valve to isolate the foam on beer valve.

14. A system as set forth in claim 13 wherein the isolation control valve is positioned downstream of the foam on beer valve.

15. A gas recovery system for a beverage dispensing system, the gas recovery system comprising:

means for drawing gas from an at least partially used beverage container;

a compressor downstream of said at least partially used beverage container;

a gas separator downstream of said compressor;

a gas storage vessel downstream of said gas separator;

a gas blending unit downstream of said gas storage vessel for blending the separated gases to a required composition of gases; and a pressure reducing valve between said gas storage vessel and said gas blending unit, wherein in use the gas recovery system is configured to draw gas from the at least partially used beverage container and to separate said gas into component gases by passing said gas through said gas separator, and to selectively direct at least one of the separated component gases to said gas storage vessel.

16. A system as set forth in claim 15 wherein the required composition of gases is supplied for use by said beverage dispensing system.

17. A system as set forth in claim 15 wherein the compressor comprises a sealed downloading system for reducing pressure in the compressor at the end of the gas recovery cycle.

18. A system as set forth in claim 17 wherein the sealed downloading system comprises a downloading vessel to which at least some of the gas remaining in the compressor at the end of the gas recovery cycle is downloaded.

19. A system as set forth in claim 18, wherein upon starting a new gas recovery cycle any gas remaining in the downloading vessel is returned to the gas recovery system.

20. A system as set forth in claim 15 wherein the gas separator comprises a pressure swing absorption gas separator.

21. A liquid dispensing system for dispensing liquids from a beverage container, the system comprising:

two or more beverage containers operably coupled to a dispense assembly enabling simultaneous dispensing of liquid from the two or more beverage containers, each of the two or more beverage containers having an associated detector for detecting at least partial use of the associated beverage container;

an exhaust gas removal assembly allowing removal of at least some gas from the beverage container which is detected as being at least partially used; and an indicator to inform an operator that the at least partially used container is ready for removal and replacement within the liquid dispensing system, wherein the system is configured to recover gas from the at least partially used liquid container without removing the at least partially used beverage container from the beverage dispensing system.

22. A system according to claim 21 comprising five or more beverage containers simultaneously coupled to the dispense assembly and enabling automatic processing of each of the five or more beverage containers.

23. A system according to claim 21 further comprising a gas recovery system coupled to the exhaust gas removal assembly.

24. A liquid dispensing system of claim 21 comprising a gas recovery system-comprising:

means for drawing gas from an at least partially used beverage container;

a compressor downstream of said at least partially used beverage container;

a gas separator downstream of said compressor;

a gas storage vessel downstream of said gas separator;

wherein in use the gas recovery system is configured to draw gas from the at least partially used beverage container and to separate said gas into component gases by passing said gas through said gas separator, and to selectively direct at least one of the separated component gases to said gas storage vessel.

25. A liquid dispensing system as set forth in claim 24 comprising an automatic change over valve system to allow beverage dispense and gas recovery to be automatically switched between a plurality of beverage containers upon use.

26. A beverage dispensing system as set forth in claim 25 wherein a controller controls said automatic change over valve system.

27. A gas recovery system for a beverage dispensing system, the gas recovery system comprising:

means for drawing gas from an at least partially used beverage container;

a compressor downstream of said at least partially used beverage container;

a gas separator downstream of said compressor;

a foam on beer valve; and wherein in use the gas recovery system is configured to draw gas from the at least partially used beverage container and to separate said gas into component gases by passing said gas through said gas separator, and wherein the foam on beer valve comprises: a housing defining a chamber;

a channel positioned at a base of said chamber to allow for dispense of beverage;

a float disposed within said chamber to selectively close the channel;

the foam on beer valve further comprising an isolation control valve to isolate the foam on beer valve.

* * * * *